US009320978B2

(12) United States Patent
Musliner

(10) Patent No.: US 9,320,978 B2
(45) Date of Patent: Apr. 26, 2016

(54) CONSTRUCTION SYSTEM FOR CREATING A CUSTOMIZABLE ADHESIVE TOY PLAYSCAPE USING PRINTED ADHESIVE TAPE AND OTHER ACCESSORIES

(71) Applicant: InRoad Toys, LLC, Crofton, MD (US)

(72) Inventor: Andrew J. Musliner, Crofton, MD (US)

(73) Assignee: INROAD TOYS, LLC, Crofton, MD (US)

( * ) Notice: Subject to any disclaimer, the term of this patent is extended or adjusted under 35 U.S.C. 154(b) by 58 days.

(21) Appl. No.: 14/179,092

(22) Filed: Feb. 12, 2014

(65) Prior Publication Data

US 2015/0224418 A1 Aug. 13, 2015

(51) Int. Cl.

| | |
|---|---|
| ***A63H 33/04*** | (2006.01) |
| ***A63H 33/00*** | (2006.01) |
| ***A63H 18/02*** | (2006.01) |

(52) U.S. Cl.

CPC ..... *A63H 18/02* (2013.01)

(58) Field of Classification Search

USPC ..... 446/71, 79, 82, 108, 118, 146, 476, 446/491, 81, 96, 97, 85; 428/323; 434/81, 434/96, 97

See application file for complete search history.

(56) References Cited

U.S. PATENT DOCUMENTS

| | | | |
|---|---|---|---|
| 1,929,963 | A | 10/1933 | Youngberg |
| 3,967,031 | A | 6/1976 | Lambert |
| 4,401,050 | A | 8/1983 | Britt et al. |
| 4,576,675 | A | 3/1986 | Brux |
| 4,678,188 | A | 7/1987 | Johnson |
| 4,708,907 | A | 11/1987 | Flutti et al. |
| D294,714 | S | 3/1988 | Johnson |
| 4,825,763 | A | 5/1989 | Truskolaski et al. |

(Continued)

OTHER PUBLICATIONS

"Create a Road Tape with Toy Car Playset, My First Autobahn, 36 Yards X 2 Inch." Amazon.com: Create a Road Tape with Toy Car Playset, My First Autobahn, 36 Yards X 2 Inch: Toys & Games. Donkey, n. d. Web. Available at least as of Aug. 22, 2012. <http://www.amazon.com/Create-Playset-First-Autobahn-Yards/dp/B002TPYIPM/ref%3Dsr_1_1?ie=UTF8&qid=1398181487&sr=8-1&keywords=autobahn+tape>.

(Continued)

*Primary Examiner* — Kurt Fernstrom

(74) *Attorney, Agent, or Firm* — Leason Ellis LLP

(57) ABSTRACT

A customizable adhesive toy playscape is constructed of a combination of printed adhesive playscape tape and other accessories, such as printed stickers, upstanding signs, toy vehicles, and the tape roll core that can be used by children (or adults) for creating imaginary playscape tape worlds for play, education, or other uses. The playscape tape includes any number of different types of printed indicia, such as road surfaces or natural surfaces (e.g., rocks, dirt, grass), to provide a lifelike play experience. Although the discussion of the present invention centers around construction of a playscape for toy cars, the present invention contemplates that a playscape can be reasonably constructed using playscape tape for any number of different play domains. The only necessary commonalities among these different play domains is the ability to reasonably construct them using playscape tape and relevant accessories. For instance, a different playscape such as the human bloodstream, plant capillaries, computer circuitry, computer networks, or building architecture may also be constructed using playscape tape with differently printed indicia, differently printed stickers, and different, relevant accessories.

20 Claims, 7 Drawing Sheets

(56) References Cited

U.S. PATENT DOCUMENTS

| | | | |
|---|---|---|---|
| 4,842,194 | A | 6/1989 | Halbert |
| 4,913,946 | A | 4/1990 | Sala et al. |
| D309,646 | S | 7/1990 | Halbert |
| 4,989,801 | A | 2/1991 | Thomas et al. |
| 5,000,715 | A | 3/1991 | Johnson |
| 5,168,002 | A | 12/1992 | Maietti |
| 5,212,011 | A | 5/1993 | Ishikawa et al. |
| 5,326,267 | A | 7/1994 | Brokaw |
| 5,389,438 | A | 2/1995 | Miller et al. |
| 5,622,761 | A | 4/1997 | Cole |
| 5,858,495 | A | 1/1999 | Eikmeier et al. |
| 5,950,321 | A | 9/1999 | Pena et al. |
| 5,989,708 | A | 11/1999 | Kreckel |
| 6,004,665 | A | 12/1999 | Luhmann et al. |
| 6,120,866 | A | 9/2000 | Arakawa et al. |
| 6,280,840 | B1 | 8/2001 | Luhmann et al. |
| 6,350,517 | B1 | 2/2002 | Wu |
| 6,372,335 | B1 | 4/2002 | Lühmann et al. |
| 6,386,415 | B1 | 5/2002 | Tsai |
| 6,395,389 | B1 | 5/2002 | Lühmann et al. |
| 6,403,206 | B1 | 6/2002 | Bries et al. |
| 6,409,091 | B1 | 6/2002 | Simpson |
| 6,410,135 | B1 | 6/2002 | Hamerski et al. |
| 6,503,618 | B1 | 1/2003 | Jakobi et al. |
| 6,511,466 | B1 | 1/2003 | Nagami |
| 6,521,337 | B2 | 2/2003 | Yanagiuchi |
| 6,554,685 | B2 | 4/2003 | Lish |
| 6,647,893 | B1 | 11/2003 | Fugitt et al. |
| 7,676,948 | B2 * | 3/2010 | Miles ..... 33/758 |
| 8,245,807 | B2 | 8/2012 | Frank et al. |
| 8,282,438 | B2 | 10/2012 | Tamulewicz et al. |
| 2001/0003872 | A1 | 6/2001 | Pederson |
| 2001/0006726 | A1 | 7/2001 | Arakawa et al. |
| 2010/0112337 | A1 * | 5/2010 | Coben ..... 428/323 |

OTHER PUBLICATIONS

"Civil Engineer Tape: Copernicus Toys." Civil Engineer Tape: Copernicus Toys. N.p., n.d. Web. Available at least as of Dec. 21, 2013. <https://www.copernicustoys.com/proddetail.php?prod=TCIV>.

"Roommates RMK1720SCS Build-A-Road Peel and Stick Wall Decals." Amazon.com: Roommates RMK1720SCS Build-A-Road Peel and Stick Wall Decals: Home Improvement. N.p., n.d. Web. Available at least as of Dec. 2, 2011. <http://www.amazon.com/ROOMMATES-RMK1720SCS-Build-A-Road-Stick-Decals/dp/B006DDYOX2/ref%3Dsr_1_fkmr0_1?ie=UTF8&qid=1398188077&sr=8-1-fkmr0&keywords=playmat+road+stickers>.

* cited by examiner

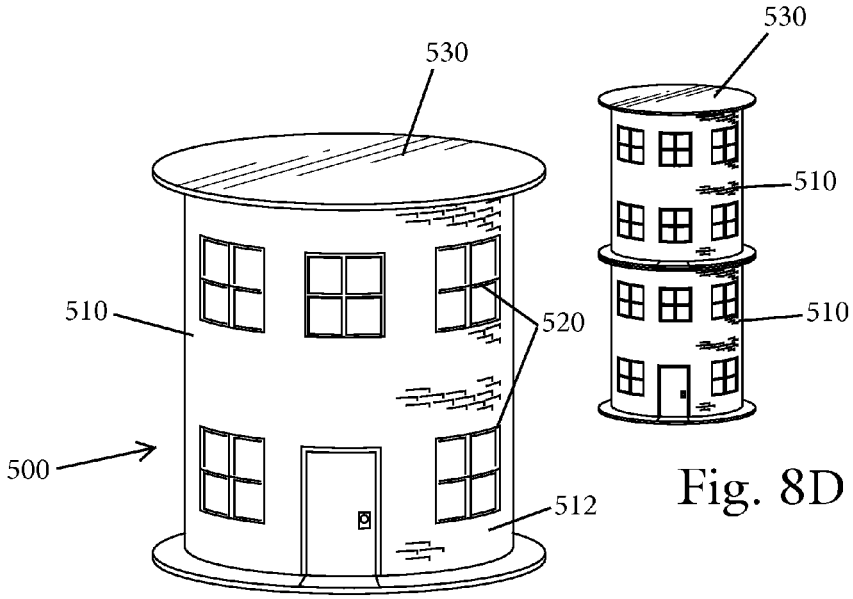
Fig. 8D
Fig. 8A
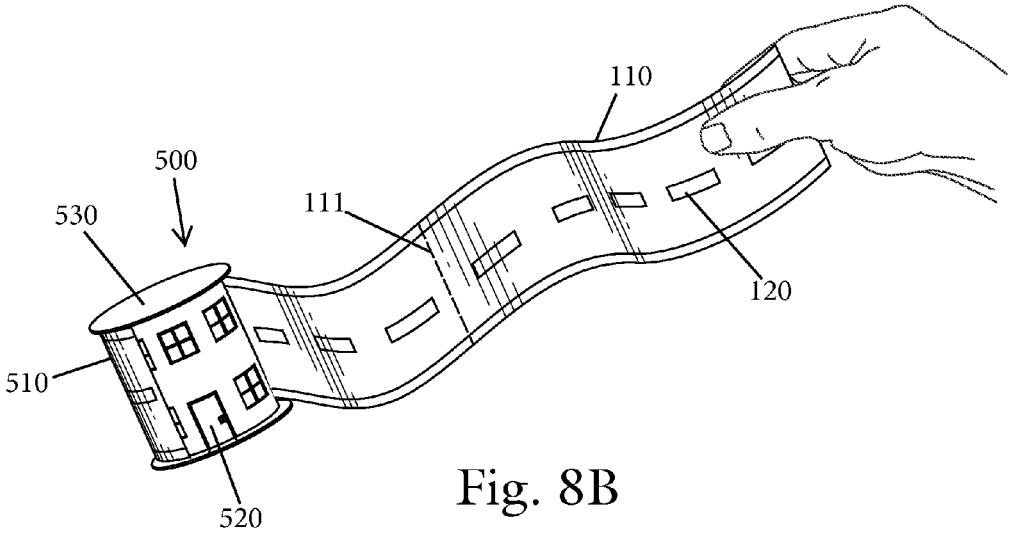
Fig. 8B

CONSTRUCTION SYSTEM FOR CREATING A CUSTOMIZABLE ADHESIVE TOY PLAYSCAPE USING PRINTED ADHESIVE TAPE AND OTHER ACCESSORIES

TECHNICAL FIELD

The present invention relates to games and toys and more particularly, to a construction system that includes a number of different pieces, including a simulated surface (e.g., a road) printed on adhesive tape, that permit a child to create unique and customizable playscapes that are removably attached to a play surface, such as a floor or countertop.

BACKGROUND

There is a wide array of different toys, games, and toy construction systems that are intended to entertain not only children but also adults.

One particular category of toys that is a favorite of children, especially boys, is toy cars. Toy cars are typically used on hard surfaces, such as a floor or countertop or the like. Children drive toy cars on imaginary or physically represented toy roads that are part of a broader playscape.

While there are some toys for constructing roads and playscapes for use with toy cars, these existing products suffer from a number of deficiencies, as noted below, that the present invention solves.

One particular toy product is a toy racetrack, on which a car travels along a fixed-path, semi-enclosed plastic track. Such racetrack is sold in sections and interconnects using a variety of proprietary connection pieces. This racetrack is expensive to purchase, bulky to store, cumbersome and in-the-way when constructed, and offers limited flexibility for arbitrary playscape design, particularly because vehicles travel explicitly in a single lane and the racetrack can only be assembled end-to-end in a pre-defined fashion, often in a pre-defined configuration suitable for downhill racing only. By contrast, the present invention provides the ability to construct fully arbitrary playscapes for imaginative play, is far lower cost, is easier to use, requires little storage, is not in-the-way when constructed, and is removable and disposable.

Another type of product is a plastic building and road set that, in some cases, interconnects with plastic racetrack and incorporates buildings with certain features (such as a "car wash" or an "auto lift"). This set is difficult and complex to assemble (requiring adult assembly typically), offers only a fixed play configuration, is extremely cumbersome to store, is frustrating for a small child because of its penchant for coming apart, and costly. By contrast, the present invention requires no adult assembly, is easier to use, enables the child to construct fully arbitrary playscapes for imaginative play, is far lower cost, requires little storage, is not in the way when constructed, and is removable and disposable.

Other products are elastic or carpet mats that have a predefined set of roads printed on the mat on which the child can drive his toy cars. Such mats are inflexible in their ability to foster creative play because they have but a single playscape design pre-printed on the mat. The plastic mats are dangerous if left unattended because they are very slippery. Carpet mats are similarly restrictive in their play value and are costly. Especially for the carpet mats, storage is a big challenge. These mats provide no construction capability, being a fixed design. By contrast, the present invention enables the construction of arbitrary playscapes, requires little storage, is not slippery or dangerous when constructed, and is far lower cost.

There are some basic tape-based products; however, these products are rudimentary as none of them begins to address the sophistication and variety of the playscape construction concepts of the present invention as will be described below. Nor do they contemplate the broad applicability of an adhesive playscape construction system such as described in the present invention. Even in their simple form, these other tapes also fail basic tests required of a suitable tape-based playscape construction toy for small children—the proper adhesive properties (easily removable, repositionable, tear-able, etc.), paper-based (none of them are paper-based), ease-of-use, and Consumer Product Safety Commission (CPSC)-approved (none is marked as a toy or identified as passing CPSIA testing). By contrast, the present invention enables the creation of an endless variety of playscapes, has the proper physical properties for use as a child's toy, is easier to use, and is already approved by the CPSC for sale as a child's toy, suitable for ages 3+, having passed required third-party testing procedures.

There is a need for an easy to use, safe, customizable, easy to store, install, reposition, and remove, playscape construction system which can be used in combination with other toys, such as toy vehicles. This invention addresses that need with a new type of toy playscape construction system.

SUMMARY

A toy playscape is constructed using a combination of printed adhesive tape (hereinafter referred to as playscape tape) and other accessories, such as printed stickers, upstanding signs, and toy vehicles, that can be used by children (or adults) for creating imaginary playscape tape worlds for play, education, or other uses. The playscape tape includes any number of different types of printed indicia, such as road surfaces or natural surfaces (e.g., rocks, dirt, grass), to provide a lifelike play experience. Although the discussion of the present invention centers around construction of a playscape for toy cars, the present invention contemplates that a playscape can be reasonably constructed using playscape tape for any number of different play domains. The only necessary commonalities among these different play domains is the ability to reasonably construct them using playscape tape and relevant accessories. For instance, a different playscape such as the human bloodstream, plant capillaries, computer circuitry, computer networks, or building architecture may also be constructed using playscape tape with differently printed indicia, differently printed stickers, and different, relevant accessories.

BRIEF DESCRIPTION OF THE DRAWING FIGURES

FIG. 8A is a perspective view of the tape roll core (that the playscape tape is unwound from) for the playscape tape shown in a first state that represents an accessory for use with the playscape tape during play;

FIG. 8B is a perspective view of the tape roll core in a converted second state;

FIG. 8D is a perspective view of a pair of stacked tape roll cores.

DETAILED DESCRIPTION OF CERTAIN EMBODIMENTS

Figure 1:
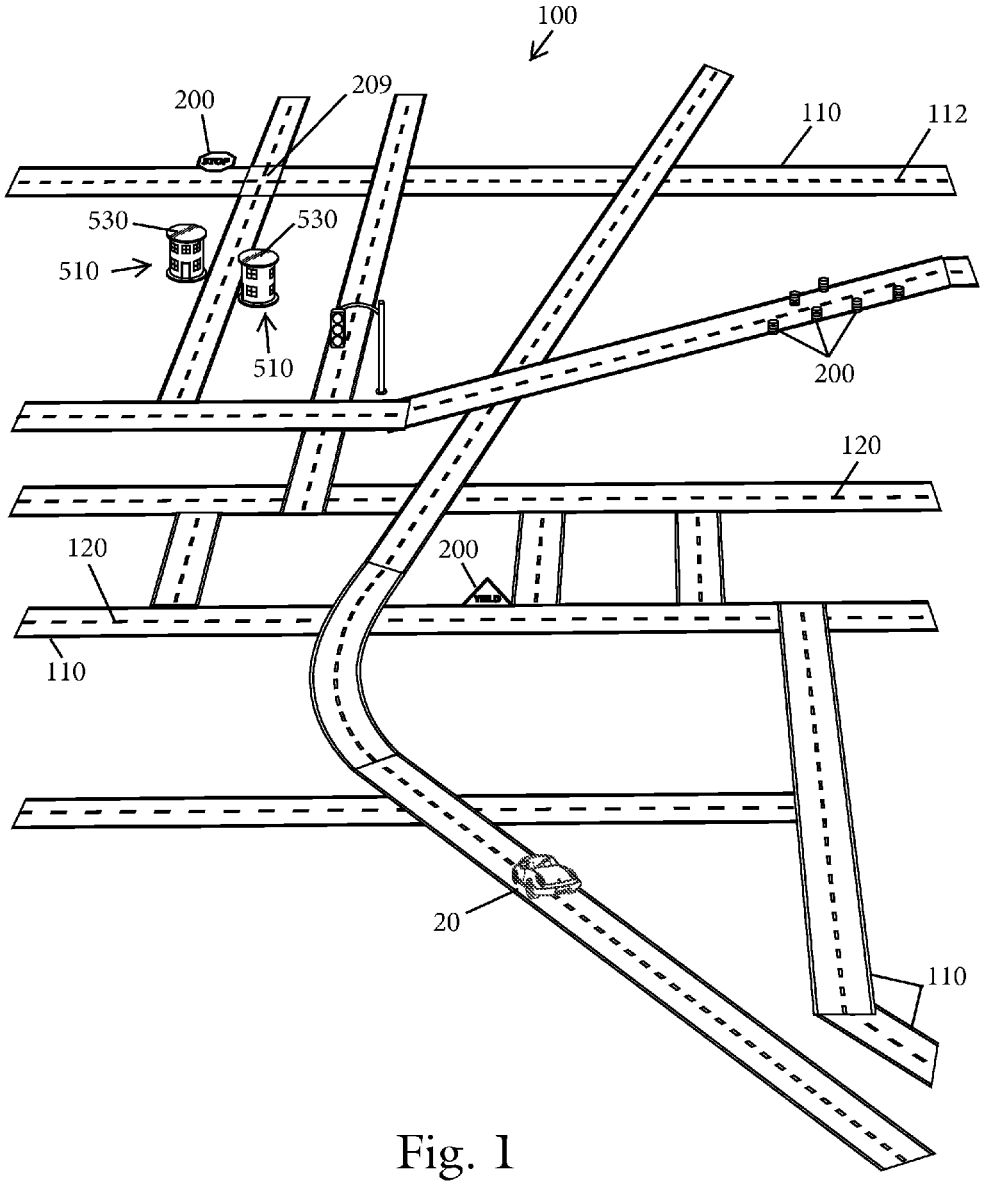
FIG. 1 is a perspective view of a playscape (play surface) constructed according to one embodiment of the present invention.

FIG. 1 is a perspective view of a custom playscape 100 (playsurface) in accordance with one embodiment of the present invention. As will be appreciated by the below discussion, the playscape 100 is based in part on the use of elongate flexible strips of material (i.e., playscape tape) 110 that contain printed indicia 120 or the like on an outer (upper) face 112 thereof and which are used by a user (e.g., a child) to construct a user definable playscape (play surface) as shown. As mentioned herein, the playscape tape 110 is preferably formed of a material (e.g., a paper based material) that can be cut or torn by the hand of the user without the use of a cutting implement, such as scissors or a knife. This allows a child to easily customize the overall playscape without the use of a potentially dangerous tool that require parent involvement and/or supervision.

Since the playscape tape 110 is preferably formed from a paper material, the printed indicia 120 can be applied using an ink printing process or the like. In other words, the applied ink is absorbed into the paper substrate the forms the tape 110 as opposed to merely being applied to a top surface. Advantageously, the absorbed ink does not easily rub off onto the child. In addition, when the playscape tape 110 depicts a road surface, such road requires a continuous print along the entire length of the tape such that there is no visible seam in the road as the design is repeated. This is challenging to perfect as part of the manufacturing process and the use of inks and paper substrate facilitates such seamless pattern. In addition, when inks and a paper substrate is used, the tape (e.g., road) is printed so that it "bleeds" to the edge. In other words, the printing goes right to the edge of the tape roll. There is no "allowance" or edge that cannot be printed on.

The above use of paper substrates and ink printing techniques is in contrast to other tapes which are made of plastics and the print easily rubs off. The use of plastic based tapes likewise prevents the above mentioned benefits from being realized.

In one embodiment, the printed indicia 120 simulates a road, highway or street for use with one or more toy vehicles 10 which can travel over the upper face 112 of the tape 110. In other embodiments described below and shown in other figures, the printed indicia 120 is not limited to a surface on which a vehicle travels but can be directed to natural surfaces, such as grass, rocks, mud, or metallic based surfaces, such as a bridge, or can relate to a surface which is restricted to pedestrian traffic such as a sidewalk or pedestrian walkway or bridge, etc. (See, FIG. 4).

The elongate playscape tape 110 has an adhesive material on a lower surface thereof which is configured to allow the lower surface of the tape 110 to be releasably attached to a support surface, as a floor, wall, table, carpet, desk, countertop, etc. The present invention contemplates that the playscape tape 110 is made of self-stick tape known (commonly referred to in the tape industry as pressure sensitive tape), since a pressure-sensitive tape is the easiest to use and most appropriate for child play. However, the present invention also contemplates that playscape tape 110 may be water-activated, heat-activated, gummed, or other non-pressure sensitive tape for a given application. The playscape tape 110 may optionally have a backing material or film that must be removed prior to use. Any number of different adhesives can be used so long as they are suitable for the intended applications described herein. For indoor use, for instance, a suitable adhesive is one in which the playscape tape 110 is secured (attached) (preferably uniformly) to the support surface but the playscape tape 110 can be subsequently removed from the support surface by lifting the playscape tape 110 and preferably, no residue is left on the support surface and no marring of the support surface results. For example, suitable adhesives (e.g., similar to adhesives used on masking tape, sticky notes, or painter's tape, etc.) are commercially available from a number of different sources.

The material from which the playscape tape 110 is formed is preferably of a type that permits the playscape tape 110 to be easily segmented as by a tearing action by the user (without the use of a tool, such as scissors). However and alternatively, the playscape tape 110 can be formed of a material that is more robust and requires the use of cutting tool (scissors) to cut the tape 110 to a desired length. Alternatively and as shown in FIG. 8B, the tape 110 can include perforations 111 or the like which permit the playscape tape 110 to be easily segmented as by tearing the playscape tape 110 along the perforation(s) 111. The user can thus select the length of the playscape tape segment by selecting which perforation 111 is to be ruptured. This versatility with respect to tape length allows the user (child) to be able to customize the playscape in that a long road segment can be combined with a shorter road segment, etc., and a complex road or landscape can be created.

FIG. 1 illustrates a series of playscape tape segments 110 of different length with some tape segments 110 intersecting one another to create traffic intersections. It will be appreciated that the user can customize and completely design a road or landscape based entirely on the user's wishes and thoughts. The user can easily simulate and replicate road and landscape of familiar places such as a local town or city. The user can also consult a map or the like to duplicate a chosen locale. For example, the user can lay down playscape tape 110 so as to create a simulated New York City landscape with playscape tape segments defining the borders (sides and ends) of the island of Manhattan and various other playscape tape segments 110 present between these border playscape tape segments for representing streets such as Broadway, etc. Alternatively, the user can create a fictional road or landscape.

Figure 2:
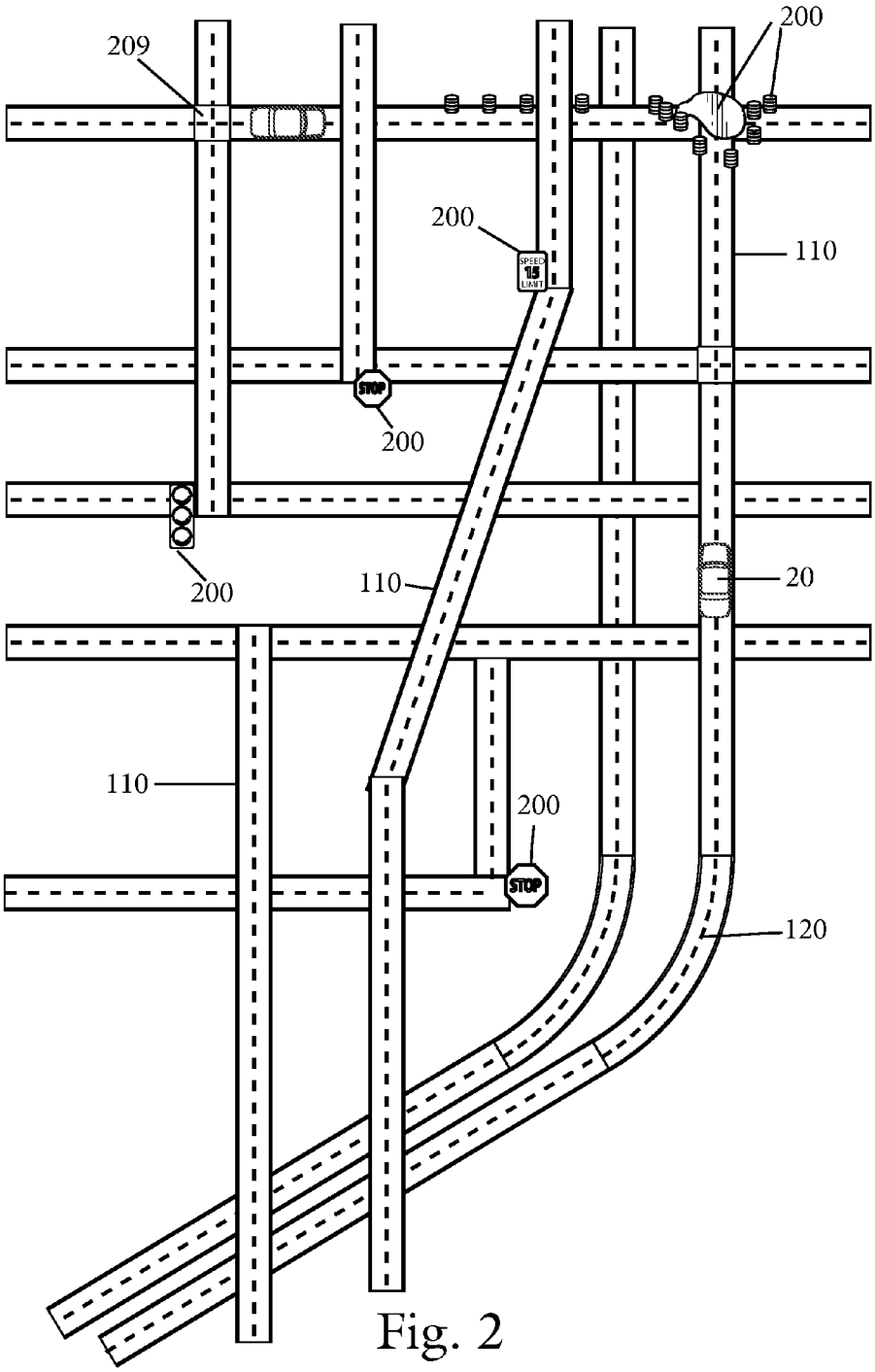
FIG. 2 is a top plan view of a playscape (play surface) constructed according to another embodiment of the present invention.

FIG. 2 illustrates yet another playscape 101 that illustrates the ease with which a customized playscape can be created.

As described herein, it is intended that other accessories are used in combination with the playscape tape 110. For example, toys, such as vehicles 20 or the like, can be used by a user who can roll the toy vehicle 20 over the playscape tape 110, thereby simulating driving the vehicle 20 along the road(s). Preferably, the road indicia 120 and the vehicle are to scale in that the vehicle can fit within one lane of the road or otherwise be contained within the natural, realistic boundaries contained as part of the indicia 120. For example, 1:64 scale for use with 1:64 toy vehicles and 1:128 scale for toy vehicles half that size. The 1:128 scale roads are reasonably 50 mm wide (2-lane, single dotted line down the center) and the 1:64 scale roads are reasonably 100 mm wide.

Other accessories that can be used as part of the playscape 100 include but are not limited to stickers and three dimensional toy pieces, such as traffic signs, buildings, signs, fences, natural landscape, such as trees, shrubs, etc.

Figure 7:
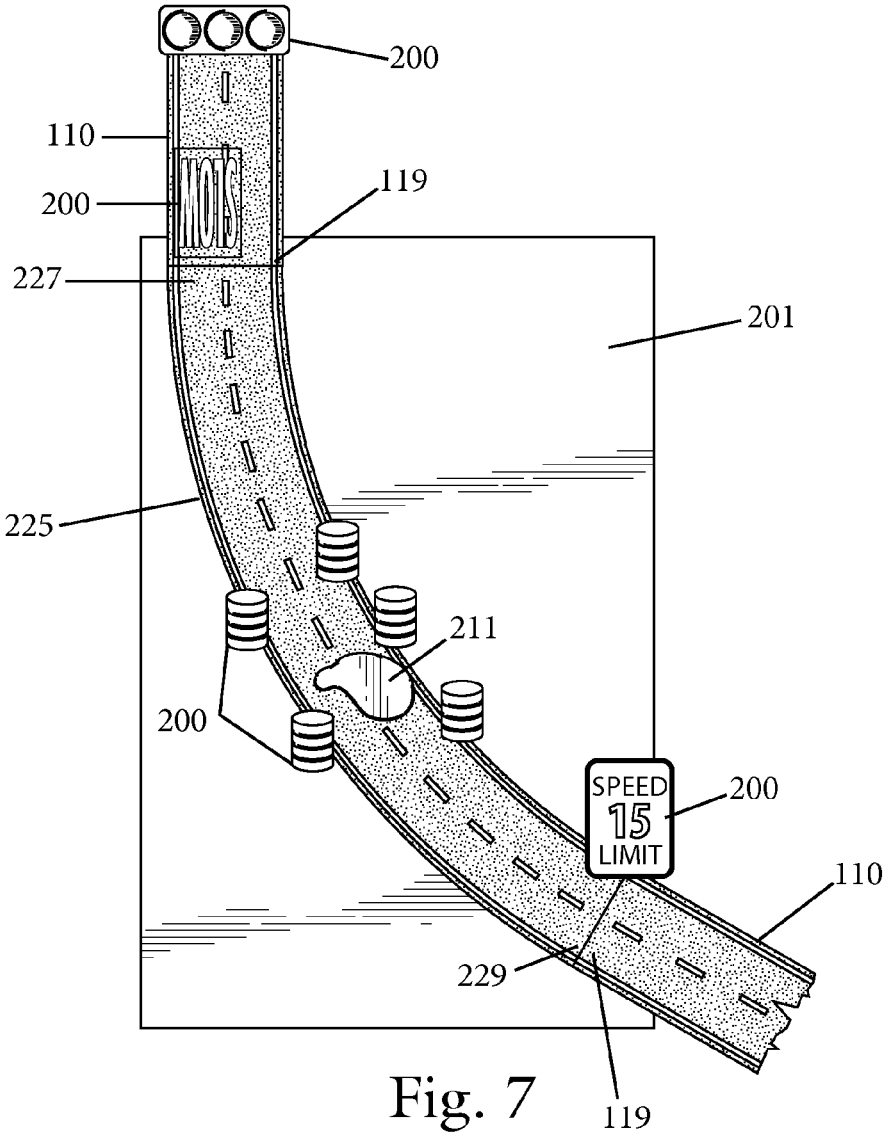
FIG. 7 is a top plan view of a segment of playscape tape including one or more stickers and further including optional accessories that can optionally be used in combination with the sensor-based system shown in FIG. 6.

FIGS. 1, 2 and 7 illustrate the use of stickers 200 as part of the play experience. The stickers 200 are thematic, pressure-sensitive stickers that enhance the specifics of any playtime scenario. In FIG. 7, the barrels, oil slick, speed limit, and traffic light are all examples of stickers 200. The stickers 200 can be die cut or perforated as individual units. The stickers 200 can be sold on sheets, individually, in packs, in trading packs, or on dispensable rolls. The stickers 200 provide the ability to customize and provide real-life accuracy to the playscape, providing pre-made intersections (where streets cross), curves and other variations where the sticker 200 provides a more detailed lifelike perspective. When the playscape tape 110 and stickers 200 are combined, the user has an endlessly variable way to create road configurations. The concept of creating your own neighborhood in a playscape tape world is easily within reach.

The stickers 200 can be of any size. The size is dependent both on the playscape tape world to which it is relevant (e.g., roads and cars vs. rivers and boats) and on the item the sticker 200 represents. Small stickers can be used to represent a pothole or the like, while larger stickers can represent buildings that line the road.

The following are exemplary play sticker themes:

Intersection and curve examples

| T intersection | X intersection | Y intersection |
|---|---|---|
| Railroad crossing | Bridge crossing | Cloverleaf |
| Merge | Curves right and left of varying degrees | S-curve |
| U-turn/No U-turn | S-curve (and other curve warnings) | |

Sign examples

| | | |
|---|---|---|
| Stop | Yield | Children crossing |
| School | Train tracks | Construction |
| Merge | No turn on red | Hospital |
| Airport | Set speed limit | Do not pass |

Light Examples

| | | |
|---|---|---|
| Traffic light | Street light | Construction zone lights |
| RR crossing lights | | |

Hazard Examples

| | | |
|---|---|---|
| Pothole | Oil slick | Trash in road |
| Bump in road | Puddle | Accident |
| Parked car | Washout from flood | Electric line down |
| Tree across road | Snowdrift | Land mine |
| Tire spikes | Barricade | Pedestrian |
| Gully | | |

Figure 3A:
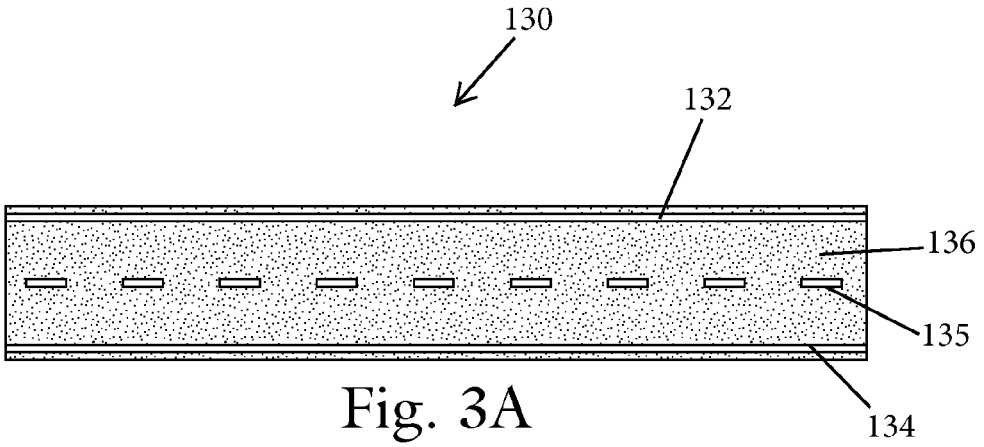
FIG. 3A is a top plan view of a single-lane playscape tape road segment.
Figure 3B:
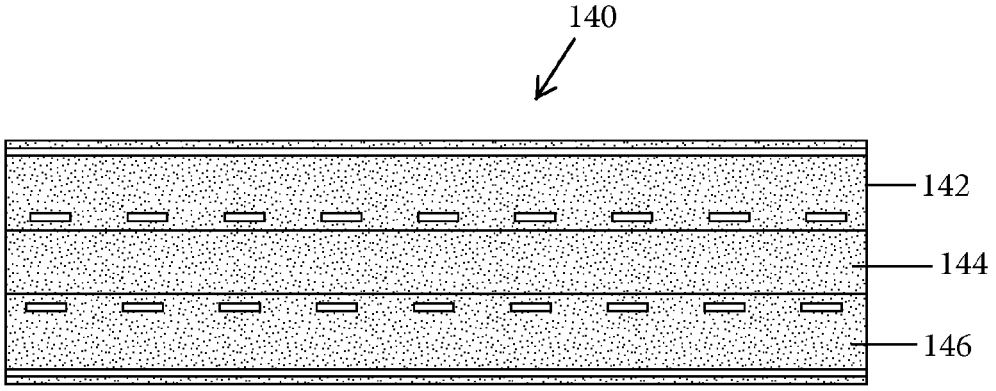
FIG. 3B is a top plan view of a multi-lane highway segment constructed of multiple single-lane playscape tape roads.
Figure 3C:
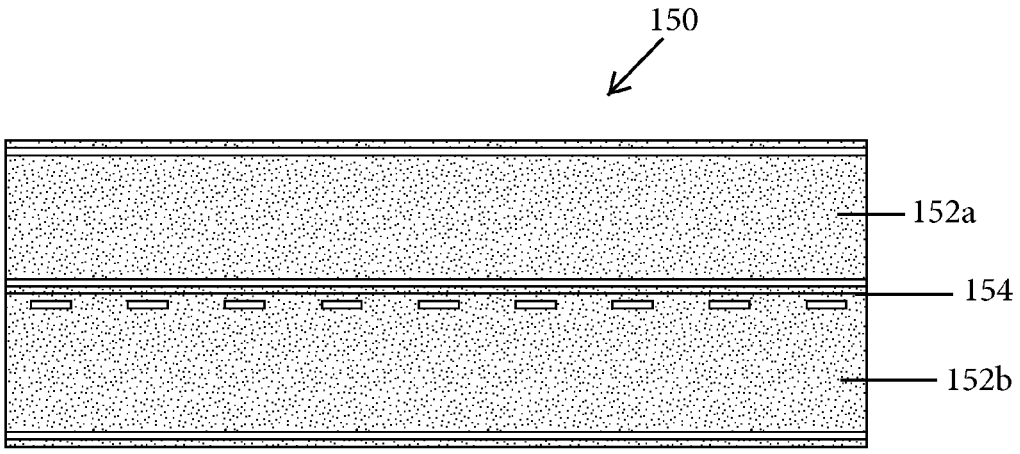
FIG. 3C is a top plan view of a two lane road segment constructed of two single-lane playscape tape roads.

FIGS. 3A-C show different possible types of roads; however, it will be appreciated that other types of roads can be simulated and represented by the printed indicia 120.

FIG. 3A shows the elongated tape in the form of a two lane road 130. The road 130 has a first side line 132, an opposite second side line 134, and a center line 135, with a portion 136 between the lines 132, 134, 135 being visually distinguishable therefrom. For example, the portion 136 can have a black color and the lines 132, 134, 135 can be white. To form an intersection, two or more segments of the road 130 intersect one another. Multiple road segments 130 can be combined to form a city block.

FIG. 3B shows a multi-lane highway 140 that is constructed by combining a plurality of separate individual playscape tape segments. For example, a single roll of playscape tape that represents a single lane is laid adjacent to and slightly overlapping another similar road segment (playscape tape segment) such that the road's right side line aligned with what will be the midline of the multilane road. The far right lane and the far left lane are the same except that their direction is opposite so the solid line is on the proper side of the road. In this way, an arbitrarily wide tape road is created, with as many lanes as desired.

The highway 140 of FIG. 3B is formed of a first playscape tape 142, a second playscape tape 144 and a third playscape tape 146 that are arranged in the preceding manner to form a three lane highway. The side lines of the second playscape tape 144 (which comprises the center lane) are not visible since the respective side edges of the other two playscape tapes 142, 144 cover such sides lines of the second playscape tape 144.

FIG. 3C shows a two lane road 150 that is constructed by combining two single-lane road segments 152*a* and 152*b*, each differently printed. The two segments 152*a* and 152*b* are lined up precisely one next to the other, going in opposite directions. The seam between the two road segments 152*a* and 152*b* is shown at 154.

Figure 4:
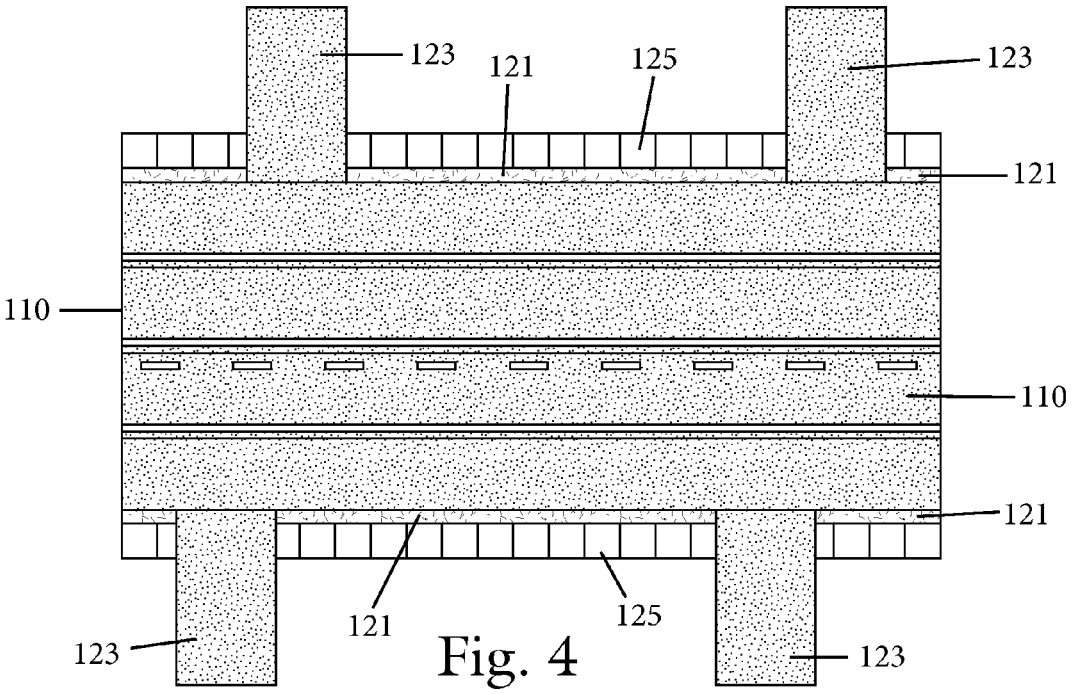
FIG. 4 is a top plan view of portion of a playscape play surface having an alternative appearance constructed according to another embodiment of the present invention utilizing multiple playscape tape segments with varying indicia.

As mentioned herein, the printed indicia 120 on the upper surface of the tape can vary from different road related indicia to nature related indicia (e.g., water or land). For example, the printed indicia 120 can simulate a dirt road, a metal bridge, a body of water (e.g., river), etc. FIG. 4 shows grassy areas 121, driveways 123 and sidewalks 125. In FIG. 3*c*, the road segment 152*b* is formed of a single lane and includes a broken line indicating a "passing zone" and road segment 152*a* is formed of a single lane and includes a solid line indicating a "no passing zone".

Based on the foregoing, exemplary printed indicia 120 include but are not limited to: paved roads, dirt roads, apocalyptic lava road, stream, river, brook/creek, sidewalk, bike path, canal, grass right-of-way, row of trees, airport runway, bridge, tunnel, subway tunnel, train track, jet stream, snowmobile path, hiking path, row of telephone poles, row of houses, row of street lights, fence (any type), snow/ice covered road, racetrack, golf course path, gravel road, cobblestone road, brick road, guardrails, etc. In yet another embodiment, the printed indicia 120 can have a non-transportation theme and in particular, the printed indicia 120 can simulate the following themes and can provide an educational and learning opportunity:

| | | |
|---|---|---|
| Bloodstream | Plant Capillaries | Computer circuitry |
| Computer networks | Building walls | |

It will also be appreciated that the composition and design of the playscape tape 110 can provide different effects including but not limited to the following: (a) glow-in-the-dark playscape tape for nighttime driving adventures; (b) playscape tape with unique glossy, glittery, sparkly, silvery, camouflage, gold or other cosmetic look that can add perceived value or make it more appropriate to a particular application; (c) playscape tape that has scalloped or otherwise not-straight edges for creative designs; (d) textured playscape tape; (e) blacklight-sensitive playscape tape; (f) blank playscape tape with a writing implement (crayon/marker) friendly surface so that a user can create their own designs on the playscape tape; (f) narrower, thinner playscape tape for use in confined spaces or for constructing smaller scale playscapes; (g) small rolls of playscape tape, both in length and core-size so the user can easily fit it into a pocket for on-the-go play; (h) playscape tape embedded with wire for follow-the-wire vehicles; (i) playscape tape with a contrasting black line imprinted on it for follow-the-line robot vehicles; (j) playscape tape with embedded radio frequency identification (RFID) playscape tapes for triggered events like turning a vehicle or making a sound or initiating a servo motor for a railroad crossing, etc., (k) perforated or small rolls of playscape tape that enable easy dispensing of a pre-defined length of playscape tape—examples include creating a runway, which has a definitive beginning and end but does not fit well on a sticker sheet; (l) playscape tape with length-wise repeating patterns for the development of board games or branded tape for corporate, education, sports team, or use as a promotional item by an affinity group; (m) playscape tape for outdoor play which includes a modified adhesive (stickier) or modified underside to support sidewalks and driveways; and (n) professional playscape tape for the remote control car enthusiast market, etc.

Figure 5:
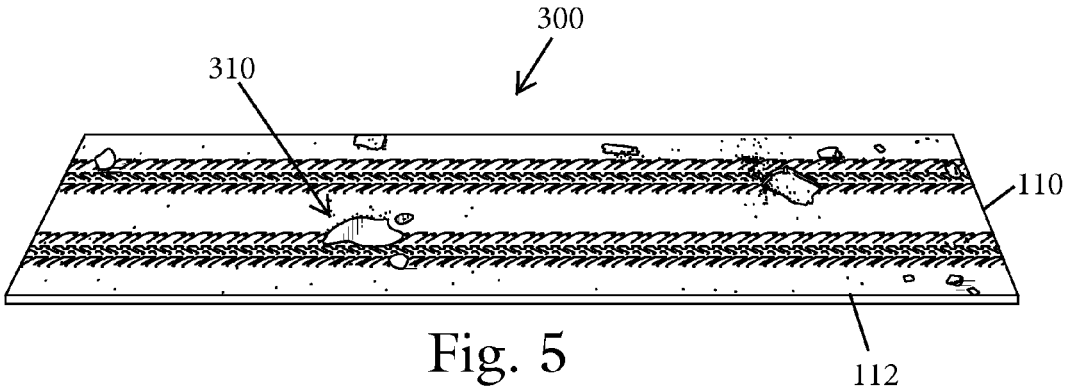
FIG. 5 is a perspective view of a segment of playscape tape that includes a topographical surface feature.

FIG. 5 shows a playscape tape 300 that has a surface modifying feature 310 that imparts a three dimensional aspect to the playscape tape 300 for simulating different road conditions or surface conditions. The illustrated surface modifying feature 310 is in the form of a uneven upper playing surface 112 of the tape 110. For example, in the case of a dirt or muddy road, the upper surface 112 is not smooth as in a paved road and therefore, the surface modifying feature 310 imparts the uneven nature of the upper surface. The surface modifying feature 310 can thus impart both raised (elevated) features, such as bumps, and recessed features, such as potholes or ruts, thereby creating a rough surface over which the toy (car) can travel. The raised feature can be any number of different features including railroad ties, rumble strips, sidewalk indentations, etc.

The surface modifying feature 310 can be formed using any number of different materials that impart the uneven surface to the tape 110. For example, a polymeric material can be applied to the base playscape tape (which can be formed of a paper material) to create the uneven surface. The surface modifying feature 310 is preferably integral to the tape 110 in that the feature 310 is not intended to be easily separable from the underlying tape 110.

Figure 6:
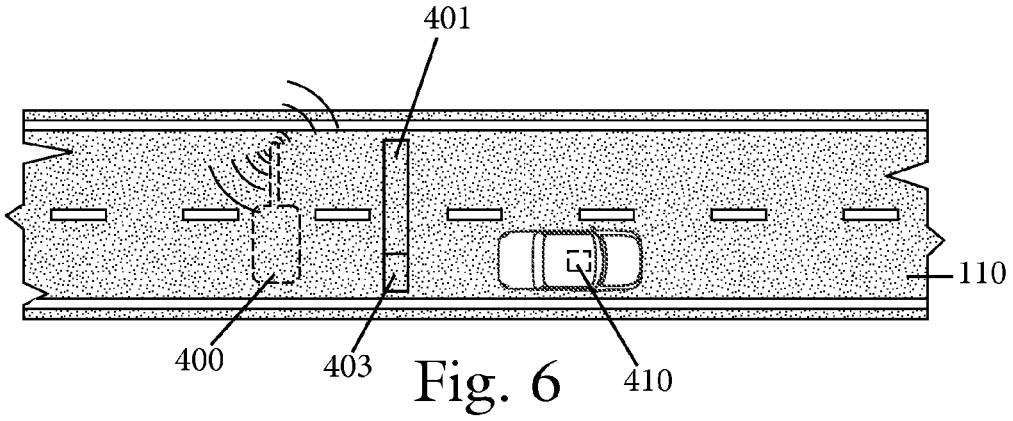
FIG. 6 is a top plan view of a sensor-based system implemented in the playscape tape and an accessory and formed of first and second sensor components.

Now referring to FIG. 6 in which a sensor based system is illustrated and more particularly, the playscape tape 110 includes a first sensor component 400 and an accessory includes a second sensor component 410. Alternatively, the first sensor component 400 can be associated with another accessory. In one embodiment, when the first and second sensor components 400, 410 are placed in proximity to one another, an event occurs and/or an operation is performed. For example, the first sensor component 400 can be a transmitter and the second sensor component 410 can be a reader that is disposed in a movable accessory such as a toy vehicle. The transmitter 400 can be embedded in the playscape tape and when the toy vehicle comes into close proximity as by driving along the road surface, the reader 410 in the toy vehicle detects the signal from the transmitter and the toy vehicle includes a processor that is in communication with the reader. Upon receiving the signal from the reader 410, the processor is programmed to perform an operation. It will be appreciated that any number of different operations can be performed including but not limited to illumination of a light in the toy vehicle, emission of a sound (such as a horn).

Alternatively, the opposite can be true in that the toy vehicle can include the transmitter 400 and the playscape tape 110 or other accessory (such as a sign or traffic light sticker 200 as in FIG. 7) includes the reader 410. Therefore, when the toy vehicle drives along the road surface, the transmitter 400 emits a signal that is detected by the reader 410 when the toy vehicle is in close proximity to the reader 410 and this causes an operation to be performed. For example, as the toy vehicle drives by a section of road (playscape tape) that includes the reader 410 and/or drives by a sign that includes the reader 410, the operation that is performed can be in the form of a light being illuminated in the road surface or sign or a sound being emitted, etc. It will be appreciated that other types of operations can be performed.

In one embodiment, the playscape tape 110 includes a first section 401 that includes at least one of a light source and speaker 403 which is visible or can be heard through the playscape tape 110 when illuminated or when sound is emitted, respectively. The first section 401 of the playscape tape 110 may be formed of a different material relative to surrounding sections of the playscape tape 110 or the first section 401 has different dimensions relative to the surrounds sections to allow the light source to be visible and/or allow the emitted sound to be heard. The light source/speaker 403 is constructed and is of such a type that the playscape 110 can be wound about a tape core.

Any number of different types of signal technology can be employed in the above scheme including but not limited to RFID, conductive sensors, magnetic sensors, etc. In each of these technologies, the reader senses a signal or other type of emission of the transmitter (sensor).

FIG. 7 illustrates another aspect of the present invention in that the sticker 225 can be configured to allow for the construction of non-linear road abutting linear playscape tape segments 110. More specifically, the printed indicia on the sticker can be in the form of an intersection, a curved road segment, etc. FIG. 7 shows the use of a sticker sheet 201 that has a sticker 225 on it with printed indicia in the form of a curved road segment that is used in combination with two linear road playscape tape segments 110. In use, the sticker 225 would be removed from the sticker sheet 201 and aligned in combination with the two linear playscape tape segments 110 as shown in FIG. 7. Since the linear playscape tape is not particularly meant to be bent to impart curves in the road, the illustrated sticker allows for the easy implementation of a curve along the road surface. The user simply aligned one end 119 of one playscape tape segment 110 with one end 227 of the curved road segment 225 and the user aligns one end 119 of the other playscape tape segment 110 with the other end 229 of the curved road segment 225. It can be appreciated that the non-linear road component stickers can be die-cut to any curve angle (e.g., an S-curve, a hairpin turn, or less sharp curve as illustrated in FIG. 7) or other non-linear configuration (e.g., a fork in the road or an intersection as illustrated by 209 in FIG. 1 and FIG. 2). FIG. 7 also shows the use of an oil slick 211 along the curved road segment 225 (printed indicia on the sticker).

FIGS. 8A-8D illustrate yet another aspect of the present invention. The playscape tape 110 is typically distributed as part of an overall product/packaging which is generally indicated at 500 in FIG. 8B and includes the playscape tape 110 as a component thereof. More specifically, a tape roll core 510 is used to contain the playscape tape 110. For example, the playscape tape 110 is typically rolled about a tape roll core 510 which is a solid structure that can be formed of cardboard or a plastic inner ring. In accordance with the present invention, the tape roll core 510 is part of the toy and can be used as a play accessory so that no part of the product is wasted once the playscape tape 110 is unwound off the tape roll core. The tape roll core 510 includes an outer surface 512 on which printed indicia 520 is formed. The printed indicia 520 is thus located underneath (beneath) the wound playscape tape 110. The printed indicia 520 can take any number of different forms and depict any number of objects, settings, landscapes, etc. For example, the printed indicia 520 can depict the exterior of a building, a set of buildings, building floor, or set of floors or some other design relevant to the design on the roll of the playscape tape 110.

One end of the elongated playscape tape 110 is detachably attached to the core 510 in such a way that the detachment of the elongated playscape tape 110 does not mar the printed surface 520 formed on the outer surface 512.

Figure 8C:
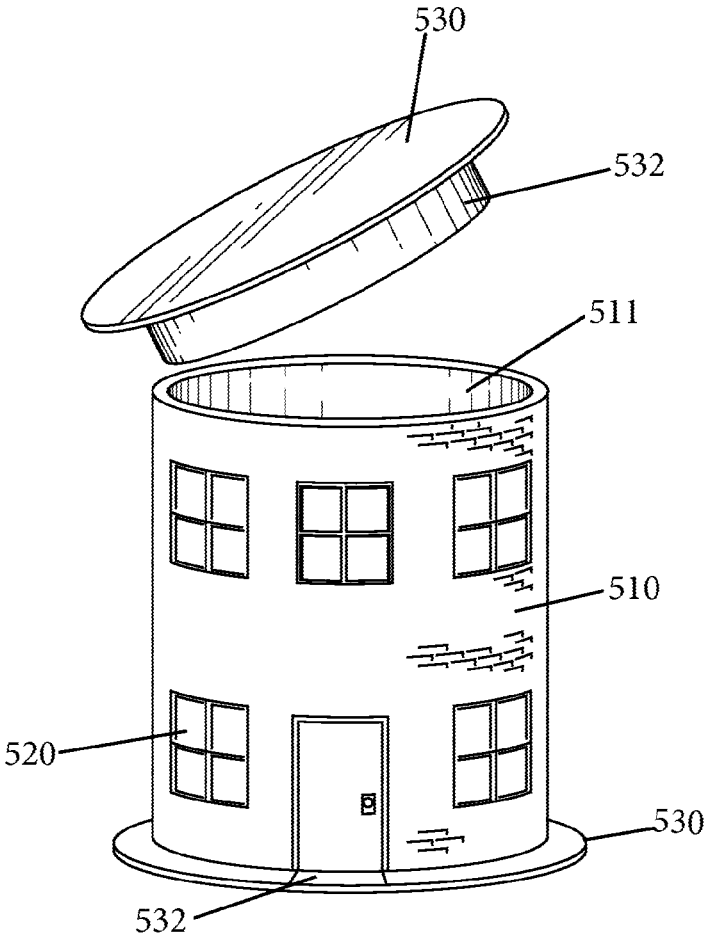
FIG. 8C is an exploded perspective view of the tape roll core with a cover being shown removed therefrom.

The tape roll core 510 is hollow as shown in FIG. 8C. The interior hollow space within the tape roll core 510 can be used for storage of accessories, such as a toy car, signs, stickers, that can be at least initially stored in this location at the point of purchase. FIG. 8D shows two tape roll cores 510 stacked.

In FIGS. 8A-8D, the printed indicia 520 is in the form of a building exterior and thus, depicts a brick building with a door and windows. The tape roll core 510 can be designed to be stackable as for example, the illustrated cylinder can be stacked on top of another cylindrical shaped tape roll core 510. For example, two tape roll cores 510 can be stacked to form a taller structure. In addition and optionally, the packaging including the tape roll core 510 can come with a cover (end lid) 530 that can serve as a roof of the building created by one or more tape roll cores 510 that include the printed indicia 520.

Other playscape tape rolls can offer a blank exterior (i.e., a blank outer surface 512) and a writing implement (e.g., marker or crayon) that can be used with the blank exterior which is both a crayon and marker-friendly surface to allow a child to create his or her own design. The tape roll core 510 and optionally the lid 530 add a third dimension to the playscape 100 and enable the user to build up a collection of reconfigurable buildings for enhancing any playscape, as illustrated in FIG. 1.

The tape roll core 510 can have a shape other than a cylinder and in particular, the tape roll core 510 can have a square or rectangle shape. Regardless of the shape, the tape roll cores 510 can be interlocked and stacked and the cover (lid) 530 can be placed on the stacked structure. In this way, the user (child) can create an entire city, with buildings and roads, out of playscape tape 110 and its built-in accessories. The lid 530 can vary in design to simulate any "top" feature, like different roof styles, etc.

FIG. 8C illustrates that the lid 530 can include a flange (a peripheral flange) 532 that is sized to be received within an opening 511 of the tape core roll 510. In other words, the outer diameter of the flange 532 is slightly less than the diameter of the opening 511 to allow reception of the flange 532 therein and preferably effectuate a frictional fit between the lid 530 and the roll 510. As mentioned herein, the lid 530 can include indicia that emulates a roof of a building or graphically depicts some other object. FIG. 8C also shows that two lids 530 can be used, one simulating the roof, the other simulating a foundation of the building. In addition, the second lid that simulates (emulates) the foundation can include printed indicia 535 such a bricks, a doorway entrance, etc. to provide a more realistic accessory.

The end section of the playscape tape 110 that is wound intimately about the outer surface 512 is preferably attached to the outer surface 512 in such a manner that the removal of this end section from the core roll 510 does not damage and mar the indicia 520 formed on the outer surface 512. For example, the end section of the tape 110 can be attached using an adhesive that does not mar the outer surface 512 when the end section is pulled off of the tape 110.

In another aspect of the present invention, a kit can be provided which includes not only the playscape tape 110 but also other accessories, such as toy vehicles 20, stickers 200, three-dimensional objects, etc. Such a kit also naturally includes the tape roll cores 500 associated with each included roll of playscape tape 110, and optionally associated lids 530. It will be appreciated that different types of playscape tapes 110 (e.g., ones with different play surfaces (e.g., one lane vs. two lanes)) can be part of the kit. This allows the user to customize the playscape, utilizing different road surfaces as part of the playscape. The kit can include playscape tapes that have simulated road surfaces formed thereon and can include playscape tapes that have simulated natural surfaces formed thereon. The natural surfaces can be dirt surfaces, rock surfaces, grass surfaces, etc. A child can thus use the different components of the kit to create a vivid realistic playscape that is easily customizable and dynamic but at the same time does not mar floors, tables, or other support surfaces.

What is claimed is:

1. A customizable toy playscape construction system comprising:

a flexible elongated playscape tape that is formed of a flexible material that can be cut or torn by hand without the use of a cutting implement to a predetermined length and has a first surface that has printed indicia on it and a second surface that carries an adhesive material to allow detachable attachment of the playscape tape to a support surface;

a tape roll core on which the playscape tape is originally wound, wherein the tape core roll includes an outer surface, about which the playscape tape is wound, that has printed indicia formed thereon that complements the printed indicia on the playscape tape to allow the tape roll core to be used as part of the playscape construction system once the playscape tape is removed therefrom; and one or more accessories for use with the playscape tape, wherein at least one of the accessories comprises a structure which can be detachably attached to either the playscape tape or the support surface, the structure including indicia that is complementary to the printed indicia on the playscape tape.

2. The playscape construction system of claim 1, wherein the printed indicia on the first surface emulates the appearance of a road surface.

3. The playscape construction system of claim 2, wherein the printed indicia has a plurality of lines that define at least one lane defined by a solid line formed along a first side edge of the playscape tape and a broken line formed along an opposite second side edge.

4. The playscape construction system of claim 3, wherein two or more flexible playscape tapes are arranged and attached to one another to construct a multi-lane road that has solid lines along both side edges thereof, with one or more broken lines being formed between the solid lines.

5. The playscape construction system of claim 1, wherein the flexible playscape tape includes an integral surface modifying feature that is formed on the first surface to create a physically uneven playing surface on the first surface, the surface modifying feature comprising a material that is disposed on the first surface to create the uneven surface that is defined by one or more elevated sections and one or more recessed sections, the surface modifying feature having indicia formed thereon simulating the appearance of a road surface.

6. The playscape construction system of claim 5, wherein the material comprises at least one of a polymeric material and rubber and the playscape tape is formed of a paper material.

7. The playscape construction system of claim 1, wherein the printed indicia on the outer surface of the tape core roll simulates an exterior of a building and packaging for the tape core roll includes a lid that is configured to seat along one side of the core and has at least one of printed indicia and a shape that simulates a roof of the building.

8. The playscape construction system of claim 1, wherein the structure of the one accessory comprises at least one sticker that includes an adhesive to allow the sticker to be attached to the first surface of the playscape tape or to the support surface and another accessory comprises a toy car.

9. The playscape construction system of claim 1, wherein the playscape tape includes a first sensor component that is at least partially embedded therein and the accessory includes the second sensor component whereupon when the first and second sensor components are in close proximity to one another, an operation is performed by a processor associated with at least one of the playscape tape and the accessory.

10. The playscape construction system of claim 9, wherein one of the first and second sensor components comprises a transmitter and the other of the first and second sensor components comprises a reader.

11. The playscape construction system of claim 10, wherein the transmitter comprises an RFID tag and the reader comprises an RFID reader in communication with the processor.

12. The playscape construction system of claim 10, wherein the reader is located in a movable toy vehicle and the transmitter is embedded within the tape, wherein the at least one operation comprises at least one of illuminating a light source and emitting a sound.

13. The playscape construction system of claim 12, wherein the playscape tape includes a first section that includes the light source which is in the form of a light that is disposed along the playscape tape.

14. The playscape construction system of claim 13, wherein the first section of the playscape tape is formed of a different material relative to surrounding sections of the playscape tape or the first section has different dimensions relative to the surrounds sections to allow the light source to be visible.

15. The playscape construction system of claim 1, wherein the one or more accessories comprises a toy car and a first accessory that is separate and distinct from the playscape tape and is intended for placement proximate to the playscape tape, the toy car including a transmitter and the first accessory including a reader whereupon when the transmitter and reader are in close proximity to one another, an operation is performed by a processor associated with the first accessory resulting in the operation occurring at a location spaced from the playscape tape.

16. A customizable toy playscape construction system comprising:

a flexible elongated playscape tape that is formed of a flexible material that can be cut or torn by hand to a predetermined length and has a first surface that has first printed indicia on it and a second surface that carries an adhesive material to allow detachable attachment of the playscape tape to a support surface;

a tape roll core on which the playscape tape is originally wound and which, once the tape is unwound, is configured for use as part of the playscape; and at least one accessory for use with the playscape tape;

wherein the tape roll core has an outer surface, about which the playscape tape is wound, that includes second printed indicia that simulates an object that is complementary to the first printed indicia on the playscape tape and is uncovered when the playscape tape is unrolled and removed from the tape roll core.

17. The playscape construction system of claim 16, wherein the second printed indicia simulates an exterior of a building and the tape roll core includes a first removable lid that is configured to seat along one side of the tape roll core and has at least one of printed indicia and a shape that simulates a roof of the building.

18. The playscape construction system of claim 16, wherein one end of the playscape tape is adhesively secured to the second printed indicia with an adhesive that permits the playscape tape to be fully removed from the tape roll core without marring the second printed indicia.

19. The playscape construction system of claim 17, further including a second removable lid that includes third printed indicia that is complementary to the second printed indicia and simulates the foundation of the building depicted in the second printed indicia.

20. A customizable toy playscape construction system comprising:

a flexible elongated playscape tape that is formed of a flexible material that can be cut or torn by hand to a predetermined length and has a first surface that has printed indicia on it and a second surface that carries an adhesive material to allow detachable attachment of the playscape tape to a support surface;

a tape roll core on which the playscape tape is originally wound; and at least one accessory for use with the playscape tape;

wherein the flexible playscape tape includes an integral surface modifying feature that is formed on the first surface to create a physically uneven playing surface on the first surface, the surface modifying feature being formed of a material that is different than a material of the playscape tape, wherein the surface modifying feature comprises a road hazard that has an uneven surface relative to the first surface of the playscape tape and has a form and shape that emulate the road hazard.

* * * * *